US006801886B1

(12) United States Patent
Pai et al.

(10) Patent No.: US 6,801,886 B1
(45) Date of Patent: Oct. 5, 2004

(54) SYSTEM AND METHOD FOR ENHANCING MPEG AUDIO ENCODER QUALITY

(75) Inventors: Wan-Chieh Pai, Fremont, CA (US); Fengduo Hu, Cupertino, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 578 days.

(21) Appl. No.: 09/716,065

(22) Filed: Nov. 17, 2000

Related U.S. Application Data

(60) Provisional application No. 60/213,114, filed on Jun. 22, 2000.

(51) Int. Cl.[7] ..... G10L 7/00; G10L 19/00
(52) U.S. Cl. ..... 704/200.1; 704/205; 704/500
(58) Field of Search ..... 704/200.1, 205, 704/221, 229, 500; 725/22

(56) References Cited

U.S. PATENT DOCUMENTS 5,893,065 A * 4/1999 Fukuchi

OTHER PUBLICATIONS

ISO/IEC 11172–3:1993, Information technology—Coding of moving pictures and associated audio for digital storage media at up to about 1,5 Mbits/s—Part 3: Audio, 1996 pp. 73–79.*

Teh et al., Efficient bit allocation algorithm for ISO/MPEG audio encoder, Electronics Letters, Apr. 16, 1998, vol. 34, No. 8.*

* cited by examiner

*Primary Examiner*—Richemond Dorvil
*Assistant Examiner*—V. Paul Harper
(74) *Attorney, Agent, or Firm*—Charles J. Kulas; Carpenter & Kulas, LLP

(57) ABSTRACT

A system for improved digital data compression in an audio encoder. A threshold is established which depends on the bit rate of the input data. A determination is made whether the bit rate is above or below the established threshold. A masking index is calculated for the input data according to a first formula if the input data is being transmitted at a rate at or below the threshold. A second formula is used to calculate the masking index if the input data is being transmitted at a rate above the threshold. The masking index is used to generate a masking threshold, and data deemed insignificant relative to the masking threshold is ignored. In the preferred embodiment of the present invention, a psycho-acoustic modeler, which is included in the encoding section of an encoding/decoding (CODEC) circuit, is used to determine a masking index. The masking index is then used to generate a masking threshold. A masking threshold is an information curve generated for and unique to each piece of audio data which enters the CODEC circuit. The psycho-acoustic modeler uses experimentally determined information about human hearing and, through a process called perceptive encoding, determines which parts of the input audio data will not be perceived by the human ear. The masking threshold is a curve below which the human ear cannot perceive sounds. The psycho-acoustic modeler compares the masking threshold uniquely generated for the specific piece of input audio data and compares the masking threshold to the input audio data. This comparison dictates to the encoding section of the CODEC circuit which of the tones and noises contained within the input audio data can be ignored without sacrificing sound quality.

8 Claims, 4 Drawing Sheets

SYSTEM AND METHOD FOR ENHANCING MPEG AUDIO ENCODER QUALITY

CROSS-REFERENCES TO RELATED APPLICATIONS

The present application claims priority from U.S. Provisional Patent Application Ser. No. 60/213,114, entitled Bandwidth Control By Using Different Psychoacoustical Models for Enhancing MPEG Audio Encoder Quality," filed on Jun. 22, 2000 and is related to co-pending U.S. Patent Application Ser. No. 09/128,924, entitled "System and Method for Implementing a Refined Psycho-Acoustic Modeler," filed on Aug. 4, 1998, which are both hereby incorporated by reference. The foregoing application is commonly assigned.

BACKGROUND OF THE INVENTION

The present invention relates to audio encoder systems, and in particular to an enhanced psycho-acoustic modeler for efficient perceptive encoding compression of digital audio data.

Digital audio is now in widespread use in audio and audiovisual systems. Digital audio is used in compact disc (CD) players, digital video disk (DVD) players, digital video broadcast (DVB), and many other current and planned systems. A problem of all these systems is the limitation of either storage capacity or bandwidth, which may be viewed as two aspects of a common problem. In order to fit more digital audio in a storage device of limited storage capacity, or to transmit digital audio over a channel of limited bandwidth, some form of digital audio compression is required.

Because of the structure of digital audio data, many of the traditional data compression schemes have been shown to yield poor results. One data compression method that does work well with digital audio is perceptive encoding. Perceptive encoding uses experimentally determined information about human hearing from what is called psycho-acoustic theory. The human ear does not perceive sound frequencies evenly. It has been determined that there are 25 non-linearly spaced frequency bands, called critical bands, to which the ear responds. Furthermore, it has been shown experimentally that the human ear cannot perceive tones whose amplitude is below a frequency-dependent threshold, or tones which are near in frequency to another, stronger tone. Perceptive encoding exploits these effects by first converting digital audio from the time-sampled domain to the frequency-sampled domain, and then by not allocating data to those sounds which would not be perceived by the human ear. In this manner, digital audio may be compressed without the listener being aware of the compression. The system component which determines which sounds in the incoming digital audio stream may be safely ignored is called a psycho-acoustic modeler.

A common example of perceptive encoding of digital audio data is that given by the Motion Picture Experts Group (MPEG) in their audio and video specifications. A standard decoder design for digital audio is given in the MPEG specifications, which allows all MPEG encoded digital audio data to be reproduced by differing vendors' equipment. Certain parts of the encoder design must also be standard in order that the encoded digital audio may be reproduced with the standard decoder design. However, the psycho-acoustic modeler may be changed without affecting the ability of the resulting encoded digital audio to be reproduced with the standard decoder design.

Early consumer products using MPEG standards, such as DVD players, were play-back only devices. The encoding was left to professional studio mastering facilities, where shortcomings in the psycho-acoustic modeler could be overcome by making numerous attempts at encoding and adjusting the equipment until the resulting encoded digital audio was satisfactory. Moreover, the cost of encoding equipment to a recording studio was not a substantial issue. These factors will no longer be true when newer consumer products, such as recordable DVD players and DVD camcorders, become available. The consumer will want to make a satisfactory recording with a single attempt, and the cost of the encoding equipment will be a substantial issue. Therefore there exists a need for a refined psycho-acoustic modeler for use in consumer digital audio products.

SUMMARY OF THE INVENTION

The present invention includes a system and method by which the criteria used by a data compression apparatus can be further refined. A threshold is established which depends on the bit rate of the input data. A determination is made whether the bit rate is above or below the established threshold. A masking index is calculated for the input data according to a first formula-if the input data is being transmitted at a rate at or below the threshold. A second formula is used to calculate the masking index if the input data is being transmitted at a rate above the threshold. The masking index is used to generate a masking threshold, and data deemed insignificant relative to the masking threshold is ignored.

In the preferred embodiment of the present invention, a psycho-acoustic modeler, which is included in the encoding section of an encoding/decoding (CODEC) circuit, is used to determine a masking index. The masking index is then used to generate a masking threshold. A masking threshold is an information curve generated for and unique to each piece of audio data which enters the CODEC circuit. The psycho-acoustic modeler uses experimentally determined information about human hearing and, through a process called perceptive encoding, determines which parts of the input audio data will not be perceived by the human ear. The masking threshold is a curve below which the human ear cannot perceive sounds. The psycho-acoustic modeler compares the masking threshold uniquely generated for the specific piece of input audio data and compares the masking threshold to the input audio data. This comparison dictates to the encoding section of the CODEC circuit which of the tones and noises contained within the input audio data can be ignored without sacrificing sound quality.

The preferred embodiment of the present invention includes a refined method and system by which the masking thresholds for each piece of audio data are determined. The psycho-acoustic modeler must be able to differentiate between data traveling at or below 192 kbit/sec and data traveling above 192 kbits/sec. In the preferred embodiment of the present invention, the psycho-acoustic modeler uses one set of coefficients when the audio data is traveling at a bit-rate above 192 kbits/sec. When the audio data is traveling at a bit-rate at or below 192 kbits/sec a second set of coefficients are used. The use of different coefficients depending on the bit rate of the input data varies the psycho-acoustic modeler to more accurately predict the data that may be safely ignored without affecting the perceived quality of the audio provided.

In another embodiment the invention provides a method for refining encoding criteria for input data in a data compression apparatus. The method comprises establishing a threshold for the bit rate of the input data; determining whether the input data is being transmitted at a bit rate above or below the established threshold; calculating a mask index for the input data according to a first formula if the input data is being transmitted at a rate at or below the threshold and according to a second formula if the input data is being transmitted at a rate above the threshold; using the mask index to generate a masking threshold; and ignoring data which is deemed insignificant relative to the masking threshold.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE SPECIFIC EMBODIMENTS

In the preferred embodiment, the present invention provides an enhanced psycho-acoustic modeler for efficient perceptive encoding compression of digital audio data. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity. The present invention includes a refined approximation to the experimentally derived masking spread function, which allows superior performance when used to calculate the overall amplitudes and frequencies which may be ignored, particularly when the digital audio is transmitted at relatively high bit rates (e.g., bit rates above 192 kbit/sec).

Figure 1:
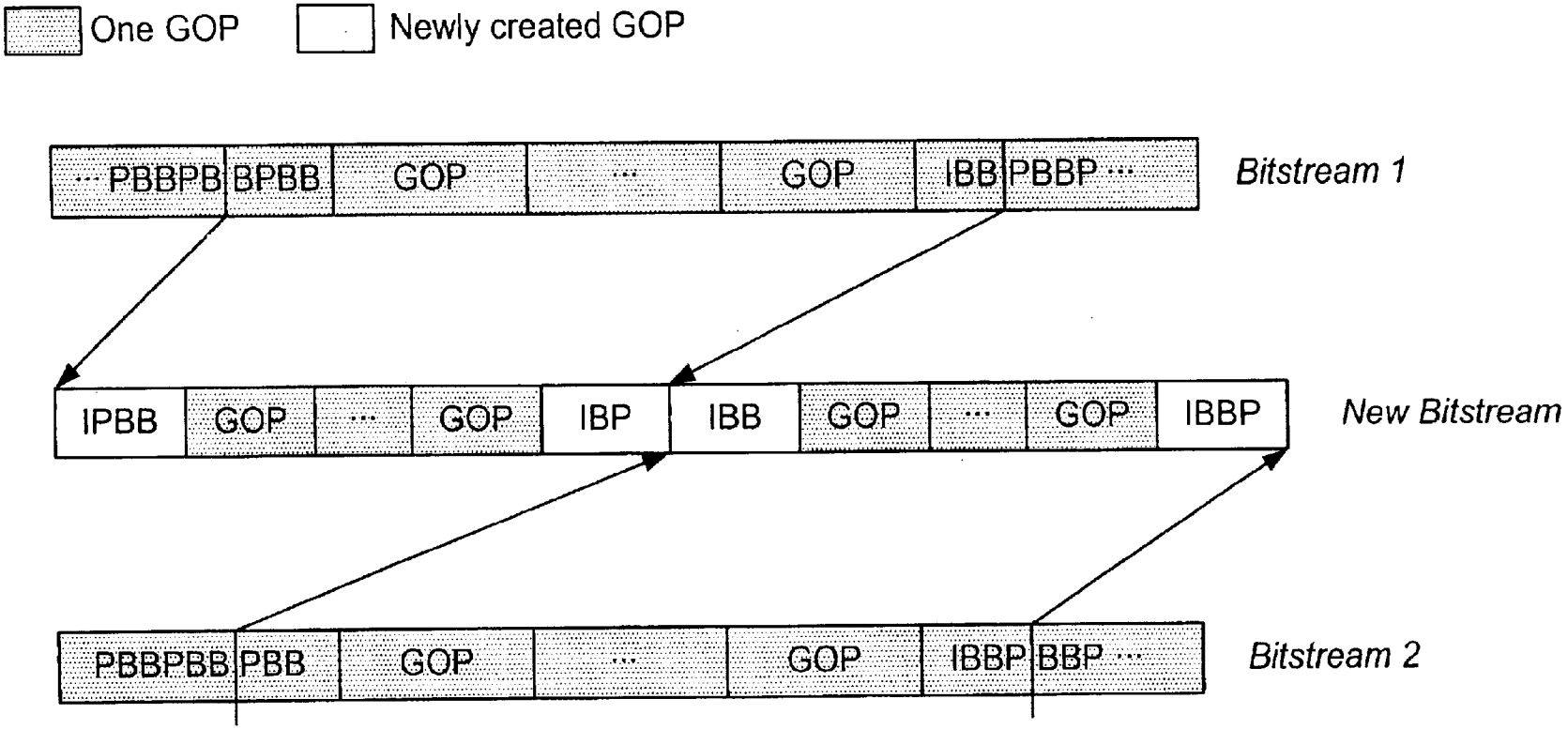
FIG. 1 (Prior Art)
FIG. 1 is a block diagram of a an encoding/decoding (CODEC) circuit utilized in the preferred embodiment of the present invention.

Referring now to FIG. 1, a block diagram of a section of one embodiment of an MPEG audio encoding/decoding (CODEC) circuit is shown. The MPEG CODEC encoding section 100 is illustrated in FIG. 1 in accordance with the present invention. MPEG CODEC encoder 100 comprises a filter bank 114, a bit allocator 130, a psycho-acoustic modeler 122, and a bitstream packer 138.

In the FIG. 1 embodiment, MPEG audio encoder 100 converts uncompressed linear pulse code modulated (LPCM) audio into compressed MPEG audio. LPCM audio consists of time-domain sampled audio signals, and the preferred embodiment consists of 16-bit digital samples. LPCM audio enters MPEG audio encoder 100 on LPCM audio signal line 110. Filter bank 114 converts the single LPCM bit stream into the frequency domain in a number of individual frequency sub-bands.

The frequency sub-bands approximate the 25 critical bands of psycho-acoustic theory. This theory notes how the human ear perceive frequencies in a non-linear manner. To more easily discuss phenomena concerning the non-linearly spaced critical bands, the unit of frequency denoted a "Bark" is used, where one Bark (named in honor of the acoustic physicist Barkhausen) equals the width of a critical band. For frequencies below 500 Hz, one Bark is approximately the frequency divided by 100. For frequencies above 500 Hz, one Bark is approximately 9+4 log (frequency/1000).

In the MPEG standard model, 32 sub-bands are selected to approximate the 25 critical bands. In other embodiments of digital audio encoding and decoding, differing numbers of sub-bands may be selected. Filter bank 114 preferably comprises a 512 tap finite-duration impulse response (FIR) filter. This FIR filter yields on digital sub-bands 118 an uncompressed representation of the digital audio in the frequency domain separated into the 32 distinct sub-bands.

Bit allocator 130 acts upon the uncompressed sub-bands by determining the number of bits per sub-band which will represent the signal in each sub-band. It is desired that bit allocator 130 allocate the minimum number of bits per sub-band necessary to accurately represent the signal in each sub-band.

To achieve this purpose, MPEG audio encoder 100 includes a psycho-acoustic modeler 122 which supplies information to bit allocator 130 regarding masking thresholds via threshold signal output line 126. In the preferred embodiment of the present invention, psycho-acoustic modeler 122 comprises a software component called a psycho-acoustic modeler manager 124. When psycho-acoustic modeler manager 124 is executed it performs the functions of psycho-acoustic modeler 122.

After bit allocator 130 allocates the number of bits to each sub-band, each sub-band may be represented by fewer bits to advantageously compress the sub-bands. Bit allocator 130 then sends compressed sub-band audio 134 to bit stream packer 138, where the sub-band audio data is converted into MPEG audio format for transmission on MPEG compressed audio signal line 142.

Figure 2:
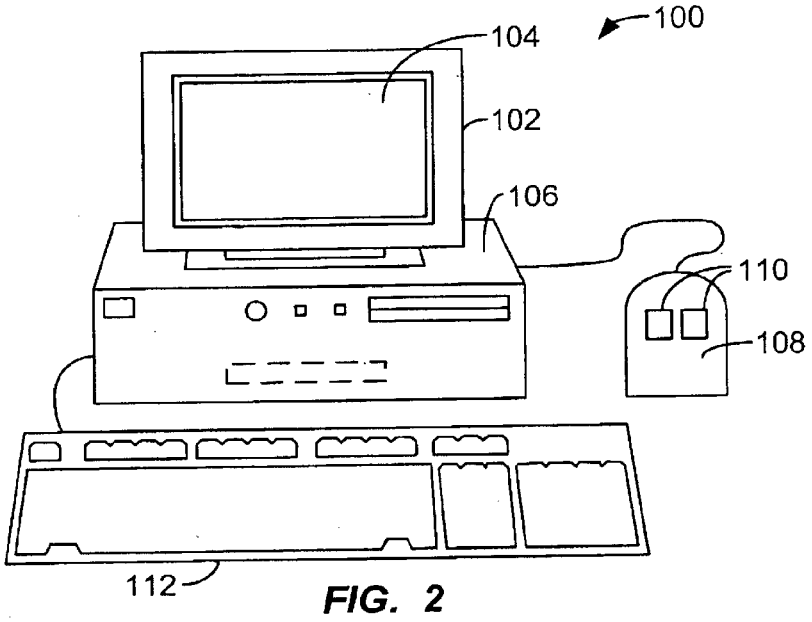
FIG. 2 is a chart showing various masking indices used in the preferred embodiment.

FIG. 2 is a chart which illustrates various masking indices. The frequency allocation of the critical bands is displayed across the horizontal axis, and is measured in Barks. The mask index function, measured in dB, is displayed along the vertical axis. FIG. 2 details the preferred mask index utilized in the present invention. Traditionally, non-tonal and tonal masking indices 210 have been utilized in MPEG audio encoder applications.

In the preferred embodiment of the present invention, psycho-acoustic modeler manager 124 uses masking indices 212 and 214. Masking indices 212 are used for input audio data which is determined to be traveling at a bit rate at or below 192 kbits/sec. Masking indices 214 are used for input audio data which is determined to be traveling at a bit rate above 192 kbits/sec.

Masking indices 210 were previously adequate for determining the non-tonal and tonal masking thresholds for input audio data. Subsequent advances in technology have rendered masking indices 210 inadequate. Masking indices 210 have been found to create masking thresholds which omit now pertinent audio information traveling at high frequencies.

To compensate for the shortcomings of the masking thresholds generated using masking indices 210, masking indices 212 and 214 are provided in the preferred embodiment of the present invention. Previous noise mask index 216 is substantially equal to a value between −3 dB and −4 dB in the first critical band. Previous noise mask index 216 decreases at a rate substantially equal to 0.3 dB/Bark. In the preferred embodiment of the present invention, non-tonal mask indices 218 and 220 are substantially equal to a value near −2 dB in the first critical band. Non-tonal mask index 220, which is implemented for audio data traveling at a bit rate above 192 kbits/sec, decreases at a rate substantially higher than the rate of decrease for non-tonal mask index 218, which is implemented for audio data traveling at a bit rate at or below 192 kbits/sec. In the preferred embodiment, the non-tonal mask index for frequencies above 192 kbits/sec is derived from the formula: av_nm−2−0.4*ltg[I].bark. In contrast, the non-tonal mask index for frequencies above 192 kbits/sec is derived from the formula: av_nm≧2−0.2*ltg[I].bark.

Psycho-acoustic modeler manager 124 also previously used tone mask index 222. Previous tone mask index 222 is substantially equal to −6 dB in the first critical band. Previous tone mask index 222 then decreases at a rate substantially equal to 0.35 dB/Bark. In the preferred embodiment of the present invention, tone mask indices 224 and 226 are substantially equal to a value between −8 dB and −9 dB in the first critical band. Tonal mask index 224, which is implemented for audio data traveling at a bit rate above 192 kbits/sec, decreases at a rate substantially higher than the rate of decrease for tonal mask index 226, which is implemented for audio data traveling at a bit rate at or below 192 kbits/sec. In the preferred embodiment, the tonal mask index for frequencies above 192 kbits/sec is derived from the formula: av_tm=−8.525−0.4*ltg[I].bark. In contrast, the non-tonal mask index for frequencies above 192 kbits/sec is derived from the formula: av_tm=−8.525−0.5*ltg[I].bark.

Mask index 212 for audio data traveling at a bit rate at or below 192 kbits/sec is composed of non-tonal component 218 and tonal component 224. As the audio data progresses to higher critical bands, the difference between the non-tonal 218 and tonal 224 components of masking indices 212 increases. This increasing difference between the masking indices 212 reduces the masking effect caused by tonal components and also reduces the effectiveness of tonal masking thresholds at higher frequencies while increasing the effectiveness of nontonal masking thresholds at higher frequencies.

Mask indices 214 for audio data traveling at a bit rate above 192 kbits/sec is composed of non-tonal component 220 and tonal component 226. As the audio data progresses to higher critical bands and thus higher frequencies, the difference between non-tonal component 220 and tonal component 226 remains constant. This consistency reduces the effect of the masking of tonal masking thresholds. This provides a reduced overall masking at higher frequencies when compared with previous masking thresholds.

Figure 3:
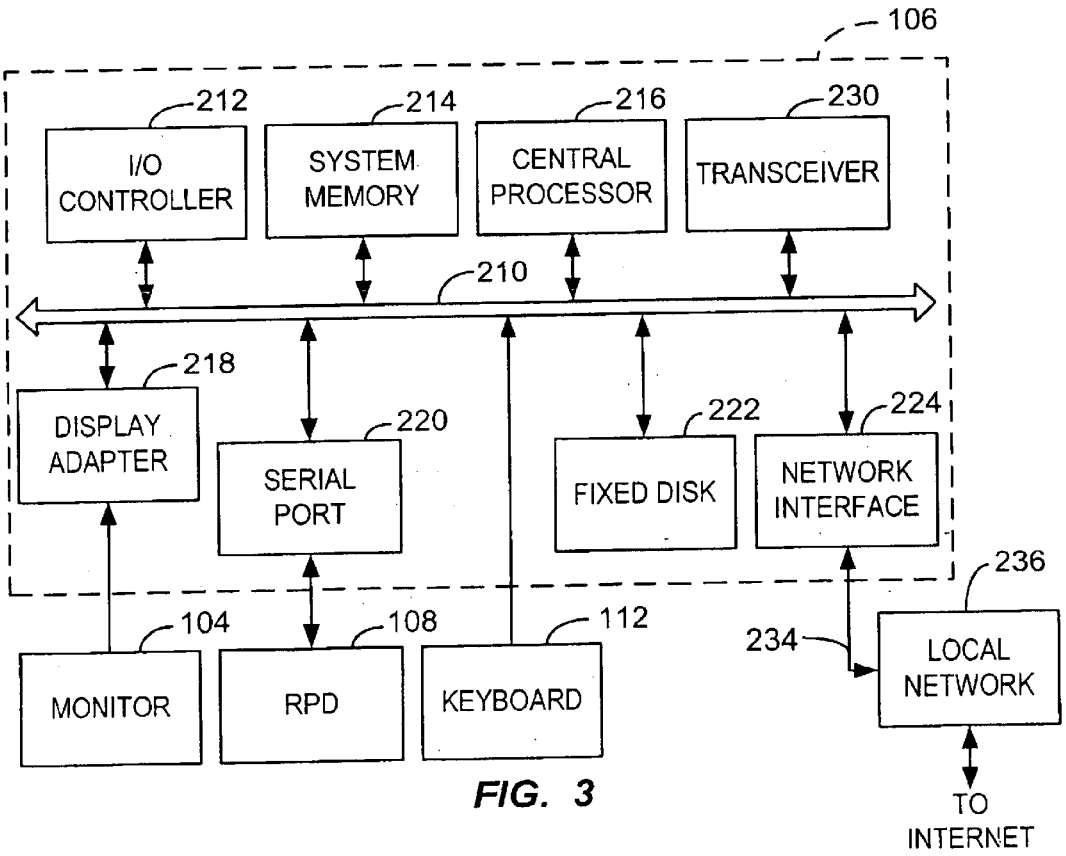
FIG. 3 is a graph showing two experimentally derived spectrograms of an output audio signal after passing through a encoding device which does not utilize the thresholding concepts of the present invention.

Referring now to FIG. 3, two spectrograms of output audio data are illustrated. Spectrograms 310 and 312 show a graphical representation of output audio data which has been processed by the encoder of U.S. patent application Ser. No. 09/128,924, entitled "System and Method for Implementing a Refined Psycho-Acoustic Modeler." In both spectrogram 310 and spectrogram 312, the time (second) is depicted across the horizontal axis, and the frequency (Hz) is displayed on the vertical axis. A plurality of dark bands 318 are used to represent the presence of output audio data at a specified frequency at that time. Dark bands 318 are generally horizontal and travel the entire horizontal length of spectrogram 310 and spectrogram 312 through all time. Dark bands 318 also each occupy a distinct energy level range on the vertical axis.

The highest frequency areas, which are represented by region 314 in spectrogram 310 and region 316 in spectrogram 312, show an obvious lack of output audio data when compared to other regions of the spectrograms. The highest frequency areas occur at all time when the frequency level is above 14,000 Hz in both spectrogram 310 and spectrogram 312. In spectrogram 310, there is a complete lack of dark bands 318 in region 314 except for a few stray dark patches 320 which are located at a frequency level just above 14,000 Hz. Similarly, in spectrogram 312, there are no complete dark bands 318 in region 316.

Although there are some stray dark patches 322 in region 316 of spectrogram 312 and stray dark patches 320 in region 314 of spectrogram 310, they are not indicative of a strong output audio data signal at high frequencies. This lack of a strong output audio signal as represented by spectrograms 310 and 312 of FIG. 3 is indicative of an inability on the part of the encoder to process high frequency audio signal components at a satisfactory level in previous encoders.

Figure 4:
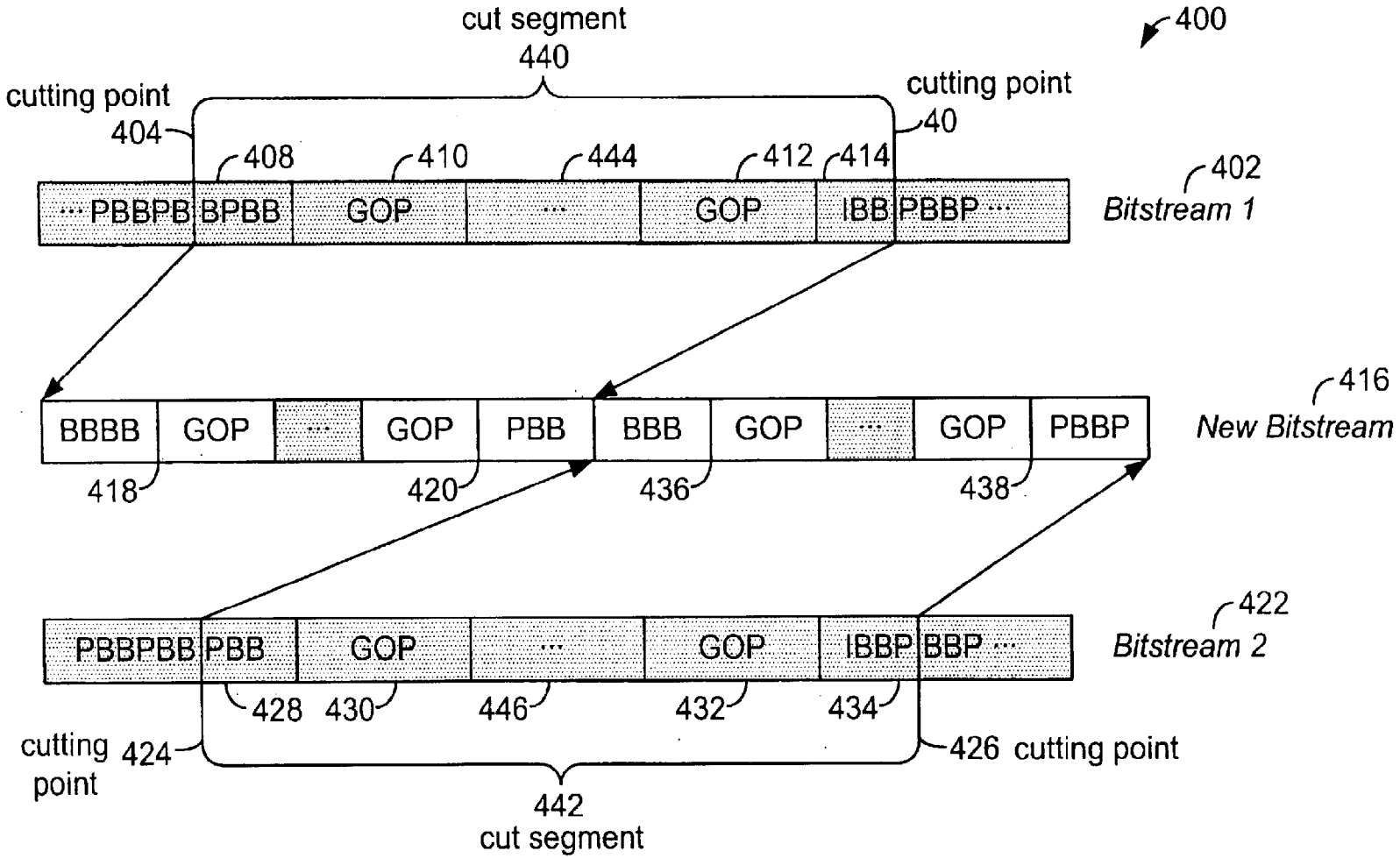
FIG. 4 is a graph showing two experimentally derived spectrograms of an output audio signal after passing through a encoding device which utilizes the thresholding concepts of the present invention.
Figure 5:
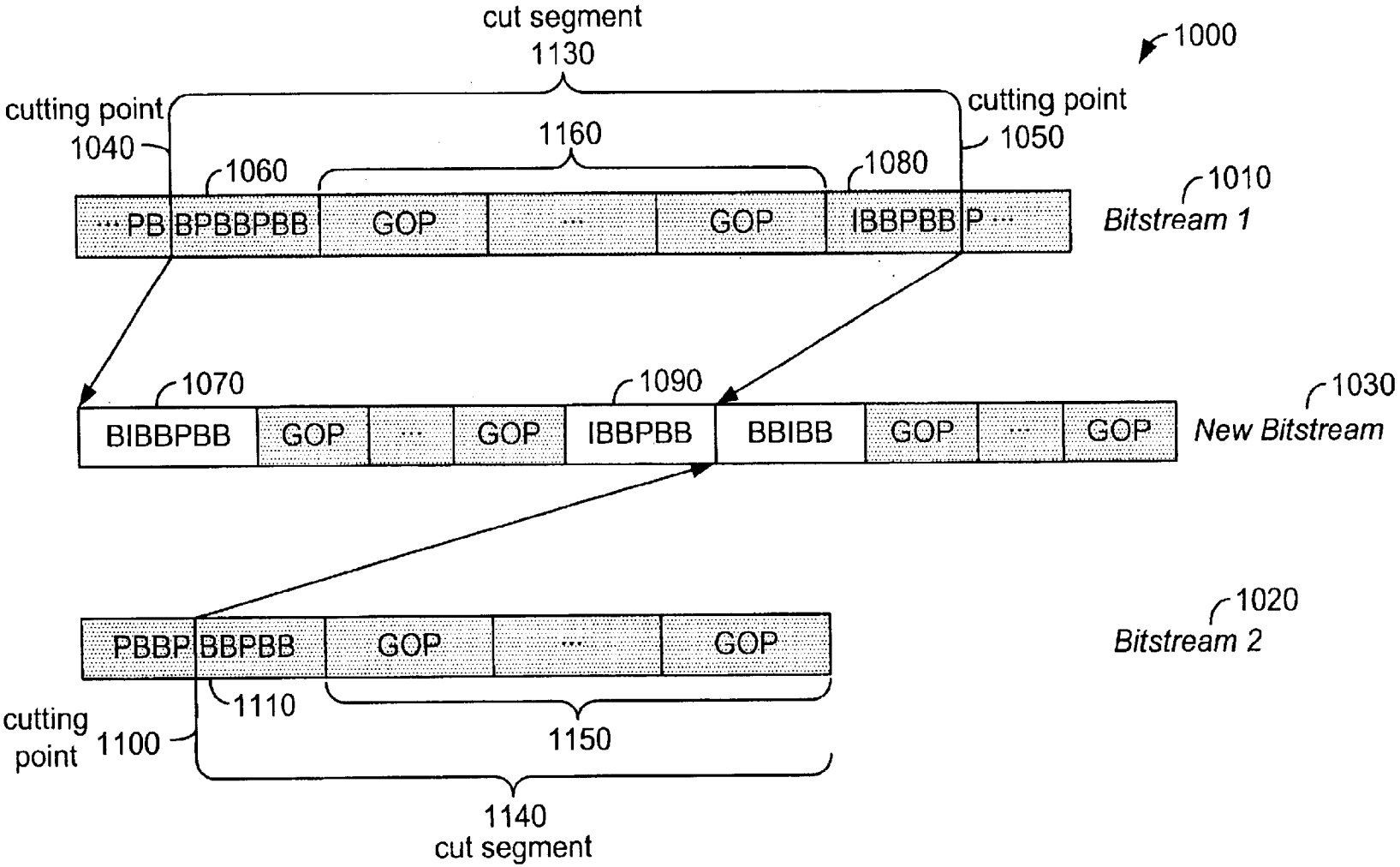

Referring now to FIG. 4, spectrograms 410 and 412 are illustrated. Spectrograms 410 and 412 were generated using output audio data from an encoder of the present invention. In both spectrogram 410 and spectrogram 412, the time (second) is depicted along the horizontal axis and the frequency (Hz) is displayed on the vertical axis. A plurality of dark bands 418 are used to represent the presence of output audio data at a specified frequency at that time. Dark bands 418 are generally horizontal and travel the entire horizontal length of spectrogram 410 and spectrogram 412 through all time. Dark bands 418 also each occupy a distinct energy level range on the vertical axis.

The highest frequency areas of each spectrogram are region 414 in spectrogram 410 and region 416 in spectrogram 412. High frequency regions 414 and 416 are located at all time when the frequency level, between 14,000 and 16,000 Hz, for all critical band rates. Band 420 in region 414 of spectrogram 410 is located at a frequency level between 14,000 and 15,000 Hz and is obvious through all critical band rates. Band 420 displays the presence of a strong audio output signal in high frequency region 414.

A plurality of bands 418 are present in high frequency region 414 of spectrogram 412. Bands 418 in region 414 are distinct and obvious between 14,000 and 16,000 Hz. Such a strong and consistent presence of bands 418 displays a very strong audio output signal at high frequencies. Although bands 418 in region 414 of spectrogram 412 are not as dark as the bands at lower frequencies, the bands in the high frequency region still represent a strong output audio signal.

In operation, the bit rate of the input data is compared to a threshold bit rate, which is 192 kbits/sec in the preferred embodiment. Depending on whether the input data bit rate is above or below the threshold, different mask index formulas are used. As a result, the mask index is dependent on input data bit rate, significantly improving the perceptive encoding.

While a preferred embodiment of the present invention has been disclosed in detail, it is apparent that modifications and adaptations of that embodiment will occur to those skilled in the art. For example, a different, or multiple, bit rate threshold may be selected. Alternatively, a different formula may be selected to compute the mask index.

However, it is to be expressly understood that such modifications and adaptations are within the scope of the spirit and scope of the invention, as set forth in the following claims.

What is claimed is:

1. A method for refining encoding criteria for input data in a data compression apparatus, the method comprising:

establishing a threshold for the bit rate of the input data;

determining if the input data is being transmitted at a bit-rate at, above, or below 192 kbits/sec;

setting a masking threshold at a first level if the input data is being transmitted at a rate below the established threshold and setting the masking threshold at a second level if the input data is being transmitted at a rate above the established threshold wherein the masking threshold specifies a power level in a frequency band; and ignoring data which is deemed insignificant in the frequency band relative to the masking threshold.

2. The method of claim 1 wherein setting a masking threshold includes a step of calculating a mask index for use in generating the masking threshold for input data traveling at a bit-rate below 192 kbits/sec using the formulas av_tm=−8.525−0.5*ltg[I].bark; (tonal) and av_nm≧2−0.2*ltg[I].bark; (non-tonal).

3. The method of claim 1, wherein a spreading function for the input data is determined using the following coefficients if the data is traveling at a bit-rate above 192 kbits/sec:

av_tm=−8.525−0.4*ltg[I].bark; (tonal) and av_nm=−2−0.4*ltg[I].bark; (non-tonal).

4. A method for refining encoding criteria in a data compressing apparatus, the method comprising:

determining if the input data is traveling at a bit-rate above or below 192 kbits/sec;

calculating a mask index for input data traveling at a bit-rate below 192 kbits/sec using the formulas av_tm=−8.525−0.5*ltg[I].bark; (tonal)

av_nm≧2−0.2*ltg[I].bark; (non-tonal);

calculating a mask index for input data traveling a bit-rate above 192 kbits/sec using the formulas av_tm=−8.525−0.4*ltg[I].bark; (tonal)

av_nm=−2−0.4*ltg[I].bark; (non-tonal);

generating a masking threshold for the tonal and non-tonal components of the input data using the mask indices; and using the masking thresholds to determine which tonal and non-tonal components of the input data can be eliminated.

5. A data compression apparatus comprising:

means for establishing a threshold for a bit rate of input data;

means for determining whether the input data is being transmitted above or below the established threshold;

means for generating a masking threshold according to a first formula if the input data is being transmitted at a rate below the established threshold and according to a second formula if the input data is being transmitted at a rate above the established threshold, wherein the masking threshold specifies a threshold power level in a frequency band;

means for determining a current power level indicated by current data in the frequency band;

means for ignoring at least a portion of the current data in the frequency band that is below the current power level; and means for determining if the input data is being transmitted at a bit-rate above or below 192 kbits/sec.

6. The apparatus of claim 5, further comprising means for calculating a mask index for use in generating the masking threshold for input data traveling at a bit-rate below 192 kbits/sec using the formulas av_tm=−8.525−0.5*ltg[I].bark; (tonal) and av_nm≧2−0.2*ltg[I].bark; (non-tonal).

7. An apparatus for encoding digital data, the apparatus comprising a filter bank for converting a digital input signal into a frequency domain, wherein a plurality of frequency sub-bands are defined and the power in each frequency sub-band is indicated by associated data; and a bit allocator for allocating bits for representation of the power in the frequency sub-bands, wherein the bit allocator ignores data associated with a particular frequency sub-band if the associated data represents a power value below a masking threshold, wherein the masking threshold varies dependent upon a bit rate being above or below 192 kbits/sec.

8. The apparatus of claim 7, further comprising a mask index calculator for use in calculating a mask index for generating the masking threshold for input data traveling at a bit-rate below 192 kbits/sec using the formulas av_tm=−8.525−0.5*ltg[I].bark; (tonal) and av_nm≧2−0.2*ltg[I].bark; (non-tonal).

* * * * *